US007461807B2

(12) United States Patent
Mosher

(10) Patent No.: US 7,461,807 B2
(45) Date of Patent: Dec. 9, 2008

(54) PORTABLE WINDING AND REELING APPARATUS

(76) Inventor: James Lewis Mosher, 173 Danielson Pike, Foster, RI (US) 02825

( * ) Notice: Subject to any disclaimer, the term of this patent is extended or adjusted under 35 U.S.C. 154(b) by 552 days.

(21) Appl. No.: 10/937,559

(22) Filed: Sep. 10, 2004

(65) Prior Publication Data

US 2007/0215738 A1 Sep. 20, 2007

(51) Int. Cl.
*B65H 19/28* (2006.01)

(52) U.S. Cl. ..... 242/532.5; 242/532.6; 242/403.1; 242/406; 242/533.8

(58) Field of Classification Search ..... 242/406, 242/397.2, 397.4, 403.1, 532.5–532.6, 533.8; 15/40

See application file for complete search history.

(56) References Cited

U.S. PATENT DOCUMENTS 4,057,198 A * 11/1977 Whitfield ..... 242/532.6
4,198,010 A * 4/1980 Knapp ..... 242/532.6
4,265,414 A * 5/1981 Spradling ..... 242/532.6
4,280,672 A * 7/1981 Santos et al. ..... 242/534.2
5,033,690 A * 7/1991 McIver ..... 242/532.6
5,505,404 A * 4/1996 Dubreuil ..... 242/532.6
5,566,901 A * 10/1996 Wilder ..... 242/532.6
6,027,066 A * 2/2000 Street ..... 242/532.5
6,811,110 B2 * 11/2004 Tsao ..... 242/530.2

* cited by examiner

*Primary Examiner*—Sang Kim
(74) *Attorney, Agent, or Firm*—Bernard J. Lacomis

(57) ABSTRACT

An improved winding apparatus for winding hoses and similar hose-shaped items such as those used in the firefighting industry. The apparatus includes a framework, a two piece retainer device in connection with the frame, and a retainer including first and second arcuate shaped pieces adapted for securing the hose to the winding means. Optional mechanical means for driving the device are described. Rollers, left and right guide means and a squeegee comprise a three part guide element for the apparatus which aids in the reeling of the hose.

5 Claims, 5 Drawing Sheets

PORTABLE WINDING AND REELING APPARATUS

BACKGROUND OF THE INVENTION

The invention relates to the field of winding and reeling and in particular to an improved winding apparatus adaptable for wheeled transport to and from work sites as well as being able to be motorized for heavier duty applications. The framework has a pair of wheels or rollers and winding device known as the retainer in the main section of the frame and this is for reeling in the hose. There is a three part guide means located near the bottom of the apparatus for guiding the left and right as well as up and down movement of the hose as well as knocking off debris, rocks, etc., off of the hose.

The device can be powered by hand by use of a hand crank and a set of gears adapted for a powered driving means, such as a battery or gas powered engine that can crank the gears and thence drive the retainer in order to wind the hose upon the retainer. The battery could be for example, a 12 volt dc battery.

It is thought that the apparatus would be useful in many applications including winding heavy duty hoses such as those used for fire fighting, sewage treatment and offshore waste recovery operations. Such hoses may be as long as 500' in many applications and some hose may reach even greater heights.

It is an object of the invention to provide a means for winding heavy duty hoses and able to guide the hose onto a reeling means for an easier operation that can be manual powered or motorized.

Another object is to provide a guide means in connection with the reeling means in order to perform steps of knocking off debris, guiding left/right and up down movements of the hose as it is being reeled.

Another object is to provide a portable winding apparatus that may be readily transported into and out of rough terrain such as wooded or sandy areas and having wheels and a construction like that of a dolly.

It is an object of the invention to provide a means for winding heavy duty hoses that can be adapted to fit various sized diameters of hose and can be used to store hoses after they have been reeled upon the device.

Other objects of the invention will be apparent to those skilled in the art once the invention is shown and described.

DESCRIPTION OF PREFERRED EMBODIMENT

Figure 1:
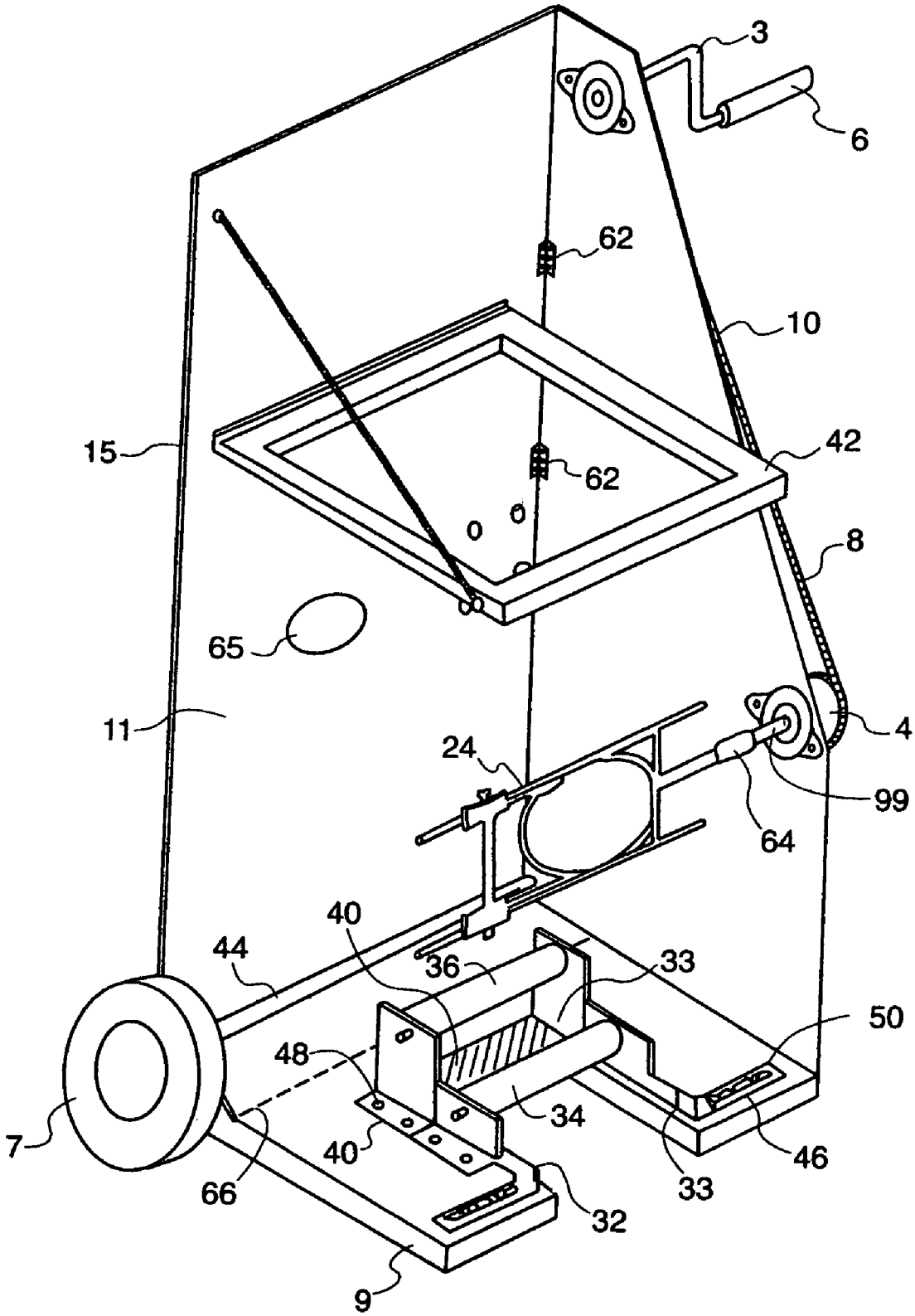
FIG. 1 overall construction of the apparatus.

The overall construction of the winding and reeling apparatus is shown in FIG. 1. There are preferably two upright sidewalls 10 in connection with a rigid base 9 and a back wall 11. The back wall is connected to the sidewalls on at least one edge and both back and side panels are connected to several edges of the base. The base is flat and designed to rest upon the ground or floor in the event that wheels are not in use (see further description below). The walls provide a framework and support for the various working parts of the apparatus.

Figure 2:
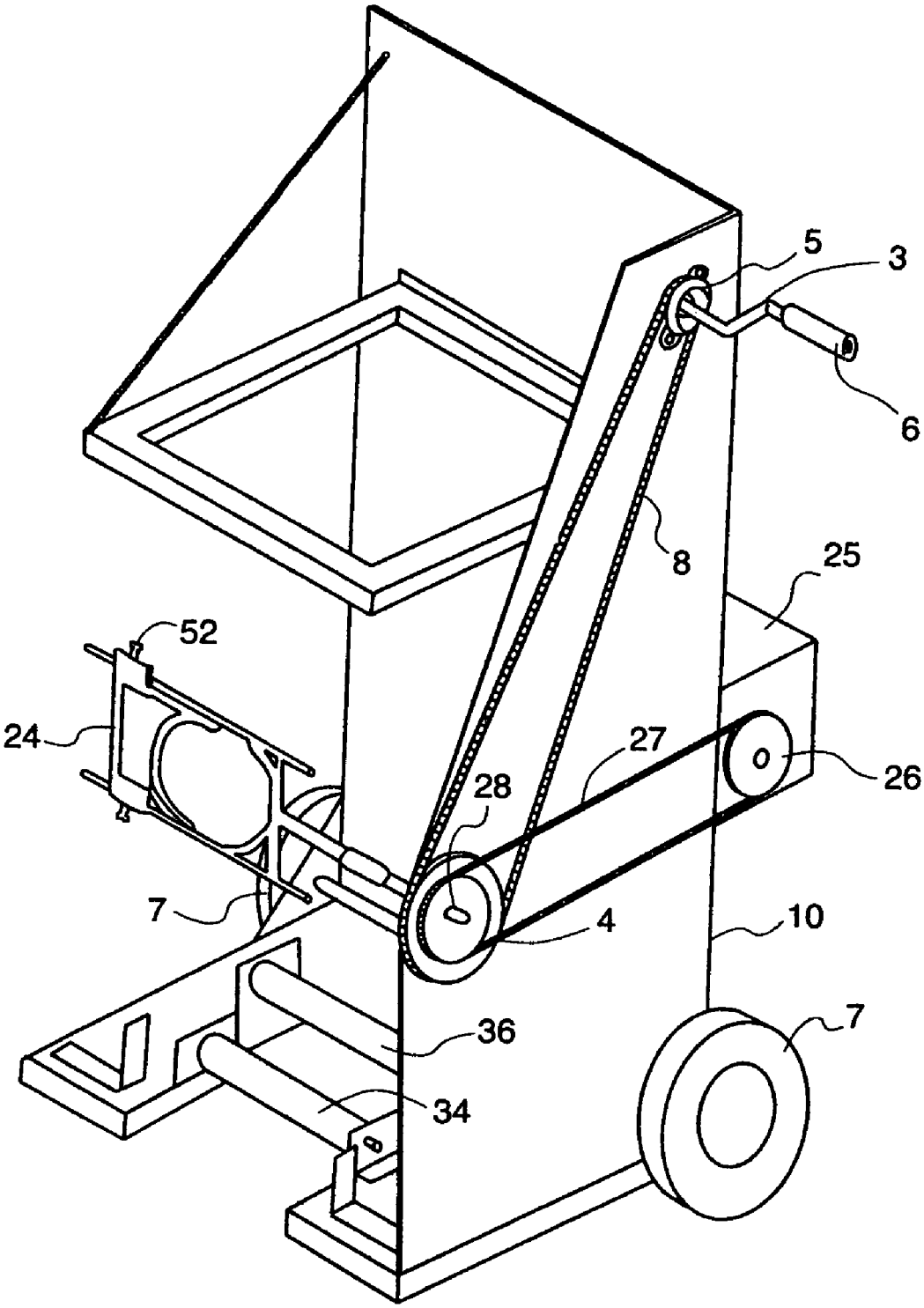
FIG. 2 perspective view of FIG. 1.

This framework may be constructed of metal or wood or other sturdy materials. The apparatus may be used in this configuration without wheels, or wheels 7 may be added to the frame, as shown in FIGS. 1 and 2. Alternatively, a handcart (not shown) may be attached to the framework by means of bolts or other means and the handcart can then be used to transport the apparatus to wherever it is desired. Such heavy-duty hoses that find use with the invention may be used in rugged terrain such as forests and so a wheeled transporting means is desirable. It is preferred that the device be used in its wheeled configuration when a heavy-duty application such as winding hoses is desired. The sidewalls 10 may be constructed with hinges (62, see FIG. 1) in order-that they maybe folded back to rest against the back wall. This is an option, but it is thought to be a preferred option.

A full scale version of the apparatus would be designed so that it can wind in large cross section, heavy-duty hose such as a fire hose or hose used in sewage treatment. Such hoses are typically 150-200 feet in length, although longer hose are also in use and can be used with the invention described herein. Other hoses thought to find use with the invention may be environmental control hoses, used to clean up oil spills and hoses used in municipal sewage treatment plants. Such hoses can run to lengths of thousands of feet and very often the task of winding such hose is done manually, i.e. by hand power.

Referring to FIG. 1, there is in connection with one wall of the apparatus a crank 3 and a gear mechanism (shown as 4 and 5 in FIG. 2) that is used to drive the retainer means 24. The gears may be connected to one another by a chain 8 or similar means for imparting rotary motion from the gear 5 to the drive gear 4. The crank mechanism can be either used as a hand powered device or a power driven crank. For manual use, the drive gear 5 would be used in connection with a handle 6 that is used to turn this gear.

The manual cranking version can be used for a heavy duty application such as a 150-200' hose. A motorized version could also be used for similar heavy duty applications and may find use in winding up even heavier hoses that may be of 300-500' and could weigh on the order of several hundred pounds. Such a motorized mechanism would be used in close proximity to the apparatus and is connected to the drive gear so as to reel in large heavy-duty hose and the like. Such a motorized device could be attached directly to the frame of the apparatus or simply used alongside it.

Details of the Retainer.

The retainer can be used to reel in both "lay flat hoses," such as fire hose and items that retain a circular cross section when not in use such as rope or garden hose. When used without the spacers 18 the retainer is used for lay flat hoses, this is the embodiment essentially shown in FIG. 3. When used with the two semi-circular shaped spacers 18, such as in FIG. 4, the retainer will roll up items of circular cross section.

Figure 5:
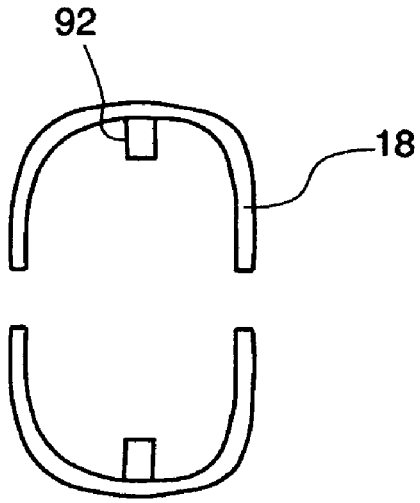
FIG. 5 cross section of spacers.
Figure 6:
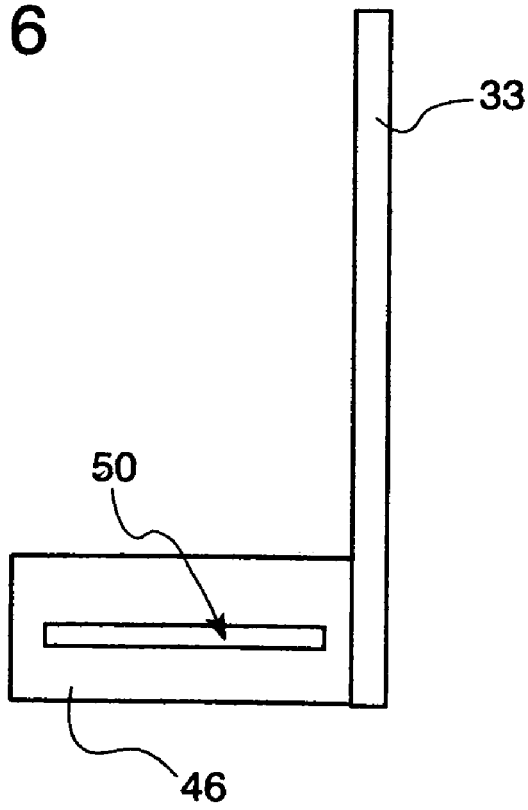
FIG. 6 detail of a guide.

A cross-section view of the spacers is shown in FIG. 5, where there is shown a square shaped eyelet 92 on the inside of each spacer that allows the spacer to be fit over the square shaped extension 24 of the retainer.

The larger gear 4 is connected to the retainer 24. The retainer acts as a connecting point for one end of the hose, cable or whatever item is being wound (see FIGS. 3 and 4). One end of the item is brought into close connection with the retainer. The two pieces of the retainer 16/24 slide, or telescope, within one another and thus can accommodate hoses of various thickness. The two pieces are slid against one another so as to form a close fit around the hose.

The two pieces may be locked into place by means of a thumbscrew apparatus (shown as 52) or other means that would allow the two pieces to move with respect to one another and which would allow these two pieces to be held in that position in relation to one another. In this manner, the two parts of the retainer can be fitted around the various size hoses. This would be at the start of the winding process so that the hose will remain in close connection to the winding apparatus as it is being reeled. The two parts of the retainer means are tightly joined to one another and this will secure that end of the hose so that it can be reeled in by motion of the crank as it turns the retainer.

Figure 3:
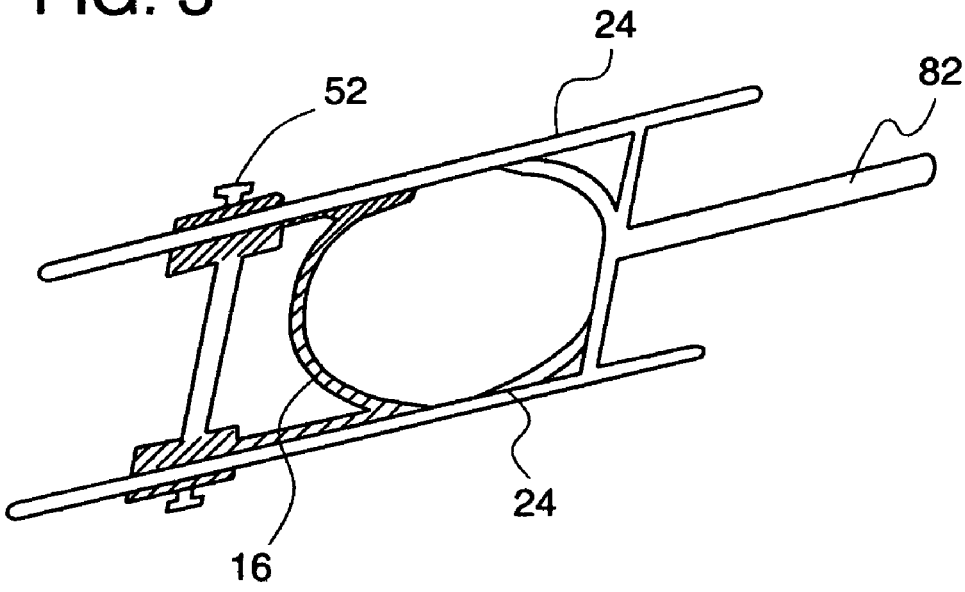
FIG. 3 overall view of the retainer.

The detail of the retainer is shown in FIG. 3. Each of those pieces 16/24 has a pair of extending prongs that form a concave or arc shaped section. This may be like the shape of the letter "u" (the "u" is turned on its side) with piece 16 being shallower in depth. Each concave section is in turn, rigidly connected to a pair of parallel straight pieces. The straight sections are at either end of the concave sections. The straight sections should be constructed so that they may slide or otherwise be moved in relation to one another.

For example, the straight sections of each piece may be made so that they telescope within one another, piece 16 goes into piece 24. The straight sections could be formed like a pipe or similar such device so that they would then telescope or slide with respect to one another. In the case of telescoping sections, the straight sections should therefore have one set of larger diameter than the other and be hollow so as to allow the other leg to slide within it. Piece 24 is thus long enough to extend over piece 16 and all the way to the plate 23 in FIGS. 3 and 4.

It is not necessary that the telescoping sections be used since any construction that allows the two sections to slide with respect to the other would therefore be acceptable. For instance, there could be a track that is in connection with the straight sections so that they can move with respect to one another.

Thumbscrews or similar such devices are preferably used in connection with the retainer pieces, so that these pieces can be locked into place and held in rigid manner so that one end of the hose can be secured to the retainer as it is being reeled in. That is to say, plate 22 is placed over the bracket 63. There is a rectangular shaped opening 87 in the middle of the plates (22 or 23) in order to provide for this, see FIG. 8. The plate is then secured to bracket with bolts, etc. (see bolt holes 80 in FIG. 8.) These bolt holes near the center of the plate and above and below the rectangular opening, show the position for the bolts to secure plate 22 to the angle bracket 63. Note additional holes 85 near the periphery of the plate are used to secure the bundle of hose after it has been wrapped. This is down by using string or rope that is looped through holes 85 and around the bundle of the hose.

Figure 8:
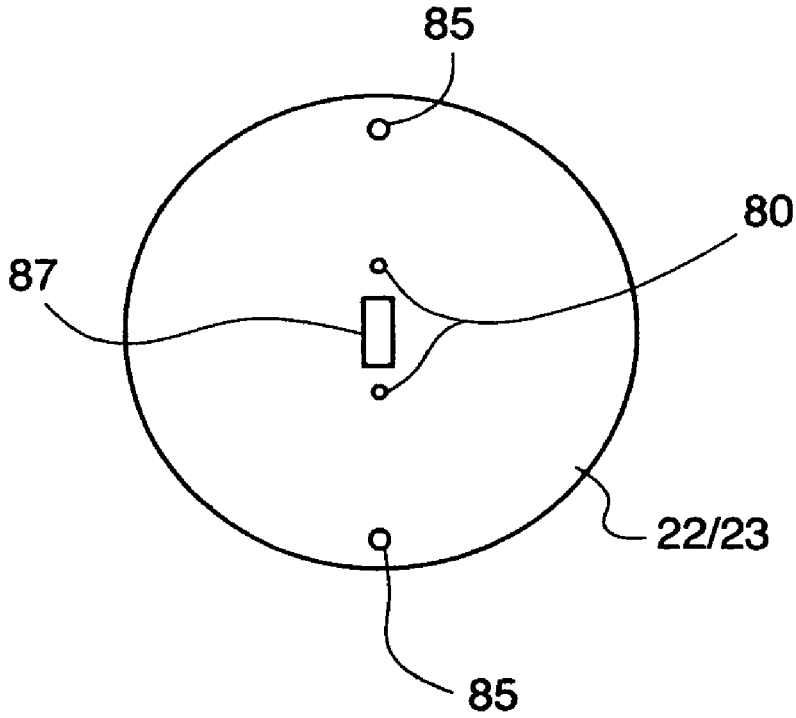
FIG. 8 front view of plates.

Retainer piece 16 is placed inside plate 23, again see the aperture in the middle of this plate in FIG. 8. Extension 24 will slide over 16 so that the end of 24 will slide past plate 23 where it will be engaged by thumbscrew 52 in FIG. 4. The same connection is used without the spacers, that is to say, the thumbscrew, plate and extension arrangement is used both with and without spacers.

Figure 4:
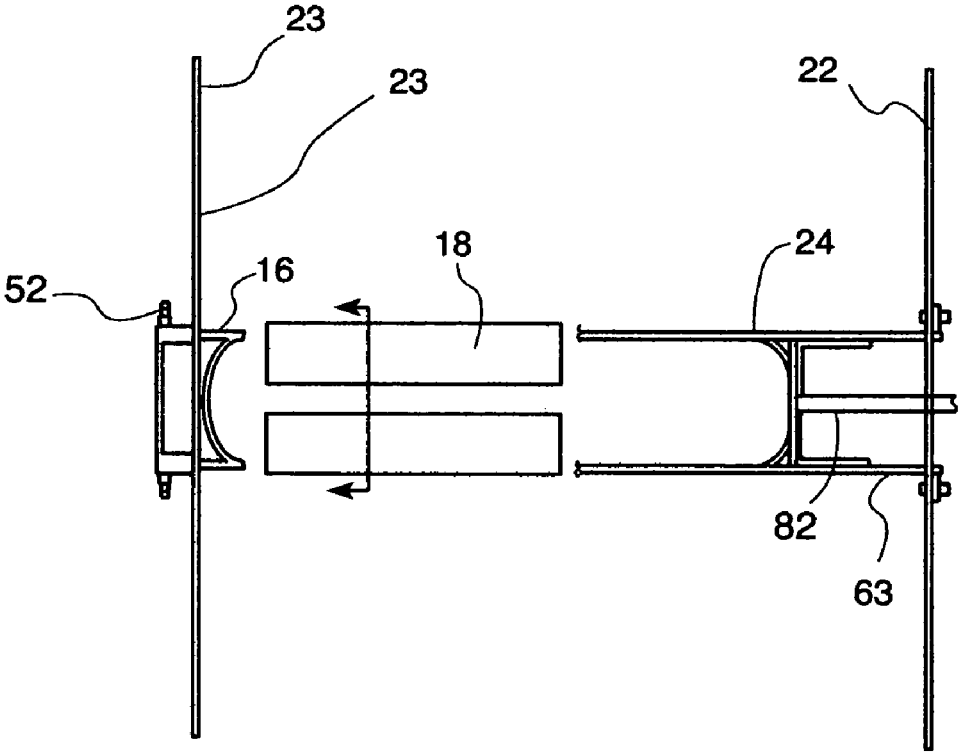
FIG. 4 detail of retainer.

The sleeve inserts 18 are used in connection with the two pieces (see FIG. 4). Each is semicircular in shape and has a square shaped eyelet inside in order to be supported on the extending piece 24. The sleeve inserts are of shape and sized adapted to support hoses, rope, etc. of circular cross section. The inserts will hold the two plates 22 and 23 apart from one another at a various pre-determined distance so that these plates may be rigidly fixed at a predetermined size for a certain amount of hose. Thus the inserts will provide a support surface on the inside of the middle of the core of rope or hose that is being formed by the reeling.

After the hose has been reeled it is necessary to remove this bundle (the coil of hose) from the retainer. The thumbscrews 52 are loosened and the user would pull on the retainer 16 in FIG. 4. The reel plate 23 will now easily slide off of no. 16 since it was held by the pressure from the back of 16 vis a vis the spacers. When the thumbscrew is loosened, 16 comes off of 24 and there is no longer any pressure to hold the plate 23. (similar situation holds the plate when spacers are not used). Removing the plate 23 will reveal spacers 18 on the inside of the formed, the two sleeve inserts or spacers 18 will now fall into the middle of the core since there is no longer anything to urge them against the inside of the coil of hose, rope, etc. After clearing 24, the spacers are easily removed in this manner.

After all applicable work is done by the reeling process, you would remove the bracket 63 along with the plate 22 by loosening the bolts 80. The six pieces that comprise the reel can now be stowed for use later.

Three Part Guide System.

Figure 7:
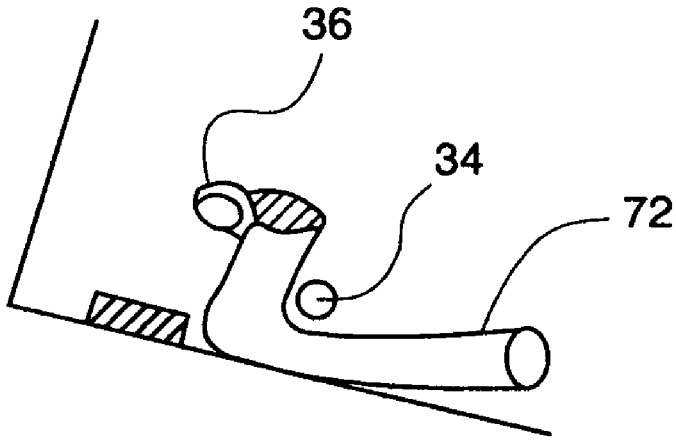
FIG. 7 side view of rollers, guide and squeegee.

There is a three part guide means near the bottom of the framework, see FIG. 1. There is a set of rollers 34/36; squeegee 40 and left and right guides (32 and 33) that work more or less in connection with one another in order to guide the hose onto the retainer 24 and knock off rocks, etc. that may interfere with this process. The side view FIG. 7 shows the relationship among these members including the hose 72 as it is being pulled through this part of the system. Note that the squeegee 40 is under the roller 36 and should be about as long as that roller.

The squeegee 40 is located on the base so that it will contact the bottom of the hose as it is being wound. It is preferred that the squeegee be approximately 2" wide and 7" long and perhaps ¼" thick. Such dimensions are merely preferred and should not limit the scope of this aspect of the device. The squeegee may be attached between the base 32 and roller supports 48. The squeegee should be composed of rubber or similar substance and its purpose is to knock dirt, rocks, etc. off of the hose as it is being reeled in. Rocks in connection with the hose may cause holes to be put in the hose in the event that the hose is reeled up with the rocks still in among the hose wraps.

There should be at least two guides, known as left and right guides (32 and 33) positioned on the frame so that they will be on each side of the hose as it is being reeled in. The guides should be adjustable in nature so that they can be set at a position to accommodate hoses of various thickness. A support 46 with slots 50 can be used for this purpose. A thumbscrew can be used in connection with the slot in order to provide a sufficient adjustment means for most applications. The adjustment would be of left and right direction so the guides can be adjusted for larger or smaller diameters of hose.

The guides would be positioned and then locked into place via the thumbscrews or other similar means. The purpose of the guides is to keep the hose from moving left or right as it is being reeled. One guide and support is shown in detail in FIG. 7. The guide would preferably be of circular cross section although other shapes are possible. Both left and right guides are of similar or same construction, they do not have a "handedness" to them.

There are rollers 34 and 36 near the bottom of the frame and positioned so that one will be above and one will be below the incoming hose (again see FIG. 7). The rollers are held by supports 48 (not shown in FIG. 7 in the interest of clarity) that may simply be angled pieces of metal or other sturdy material. The rollers 34 and 36, are used to squeeze the incoming hose 72 as it is turned upon the retainer and the pressure of the rollers will force water out of the hose as it is being reeled in. The relative position of the rollers and their spacing vis-à-vis one another should be determined by the type of hose being wound and other considerations which may be-determined by trial and error. Water in the hose will make the reeling process more difficult and the hose will not roll up as well hence the use of rollers. The rollers maybe constructed so that they are adjustable in position to accommodate hoses of different thicknesses. The rollers may also be detachable from the frame in order to substitute a different set of rollers should that be necessary.

The squeegee or abrading means 40 may be attached to the frame in a triangular relation with the rollers 34/36 as seen in FIG. 7. The squeegee should be co-planar with one roller and beneath the other roller in this embodiment. This feature is very useful since water left over in the hose after the job has been done can effect any large scale industrial reeling process since the water will impart additional bulkiness and weight to the hose and this, in turn, will increase the size and weight of the hose after it has been wound upon the retainer. Thus, having rollers to squeeze water out of the hose as it is reeled in will greatly enhance the reeling process.

As the hose is being reeled in, the hose will be guided through the rollers of the squeegee and dirt, etc. will come off. The squeegee is comprised of two rollers that can freely turn and therefore they will rub and interact with the incoming hose. For heavy duty applications, where it is desired that the device can be rolled or pushed into the woods, for example, the squeegee section of the device will have to be attached to the side walls at a point further up the walls so that the device may be transported over broken ground without logs, rock, etc. impinging on the squeegee as the device is carted over such ground. There should be a gap between the rollers of a size that is able to accommodate whatever item is being wound upon the apparatus.

Variations, Options, Refinements, Etc.

For heavy-duty applications, the crank can be connected to a motorized means such as a hydraulic powered drive. Alternatively, a heavy-duty-battery operated source of power can be used to turn the cranking section of the device automatically. Obviously, such machine assisted reeling and winding would have its greatest utility in reeling heavy equipment such as heavy hoses used in fire fighting, industrial clean up, sewage treatment, etc. An engine of this sort can be used alongside the apparatus or such an engine may be actually attached to the apparatus. The motorized machine would be used to provide motion to the crank and thus impart heavy torque force to the winding sections of the apparatus.

In a similar manner, the apparatus may be attached to a wheeled handcart or similar wheeled device in order to allow the apparatus to reel in hoses, on site. This could perhaps be out in the woods where there are rocks, and logs on the ground and this would impact on the mobility of the device. Again, it is thought that this type of operation would be for a heavy-duty application such as reeling in fire hoses from a fire out in the woods. With that in mind, there are bolt holes provided along the side walls of the apparatus in order to allow the apparatus to be bolted to a wheeled cart in order that that the apparatus can have added mobility. The squeegee roller subsystem described above would be of great usefulness in such applications.

Optionally, wheels 7, FIGS. 1 and 2, may be added to the base in order to make the apparatus function in a manner similar to a wheeled handcart; i.e., the wheels would be near the bottom edge of the apparatus so the device can be pivoted and wheeled into place. In addition to the provision of wheels or rollers on the bottom of the apparatus, the invention might have a third wheel that is deployable from for example, the back wall of the frame. This third wheel may be retractable and fold up into the back of the apparatus when not in use. It is useful to be able to pivot the apparatus upward by means of the third wheel so as to provide greater clearance in the front of the device so that the hose can travel over the front of the apparatus.

FIG. 1 shows the angle brackets 48 as a means on which to mount the rollers (34/36). The sidewall 10 may also be of hinged construction (see hinges 62 in FIG. 1) so as to permit this wall to fold flush against the back wall 11 or against one another as the case may be. There is an aperture 65 cut in the back wall to permit the nub of the shaft 90 to fit into this aperture when the sidewall is folded against the back wall, see FIG. 1. The side wall 10 will then be able to rest flush against the back wall 11.

The nub 90 is a part of the retainer construction shown in FIG. 1 and this part of the retainer would remain once the retainer 24 is removed.

The base may fold against the side or back wall in the same manner by using means to promote hinging or folding action. With that in mind, the base may be constructed in two parts with hinges along the line 66 in FIG. 1. The line depicts the two parts of the bottom wall that may have a hinge along the line, in order to permit a part of the base to fold back upon itself, see FIG. 1.

A holder or shelf 42 (see FIG. 1) may be used in connection with the top of the apparatus. The holder is used to store one or more rolled up hoses after they have been reeled in. The holder may be comprised of a shelf or similar type of unit that is held in connection with the top of the framework by a chain or a similar means that will allow the shelf to be deployed downward when it is desired to store the item on the shelf and so that it can be folded upward when it is no longer needed.

As stated above, in the event that the apparatus is enhanced with the use of a wheeled attachment it is believed that the squeegee section would have to be elevated in relation to the bottom sides of the sidewalls of the apparatus. Thus it would be attached to the walls of the apparatus at a point higher up along the walls than that shown in the drawings. This is so as to leave a proper amount of clearance between the bottom of the device and the ground that the apparatus is being hauled over in the event that the apparatus is hauled over rocks, logs, etc.

For less heavy duty applications, a hand crank may be used on the apparatus. The device could be downsized for lighter applications, such as those used in routine household applications such as winding things like garden hoses, yarn, twine, string, rope, etc. The device would obviously be made on a smaller scale than the larger scale device that is designed to reel in heavy duty hoses.

Lighter applications, such as using the apparatus in a domestic setting to wind string, would not require powerful machinery in order to drive the crank and the gears. A manual device, i.e., where the crank is powered by hand, would be sufficient for these applications. Hence, the powered assist for the crank would only be used as the occasion warranted it.

I claim:

1. An improved winding apparatus for winding hoses and similar hose shaped items having a circular cross section and running perpendicular to said cross section as it is reeled in by said apparatus; said apparatus comprising: a framework having a planar shaped base and having a pair of wheels in connection with said apparatus, upstanding side walls and a back wall forming jointly with said base a generally open volume, a two part-retainer having first and second arc shaped retaining means shaped for securing said hoses around the cross section thereof, each having a shape reflective of the other so as to form two generally equal sized arcs, a means for providing relative movement among said first and second arc shaped retaining means toward and away from each other and perpendicular to the axis of said hose, and a means for securing said arc shaped means a fixed distance from one another, a guide means having three parts, said guide means supported by said framework, said parts comprising a pair of rollers shaped to roll in a direction along the axis of said hose, and being of size and shape to interact with said hose, a pair of left and right guide means of adjustable distance from one another and capable of guiding said hose for movement along said axis and in a direction perpendicular to that of said pair of rollers, and an abrading means in close connection with said rollers and in frictional contact with said hose as it moves by said rollers so as to remove debris from the hose; said retainer apparatus connected to a means for driving said retainer in a rotary motion so as to wind the hose upon said retainer.

2. The apparatus of claim 1 where said drive means comprises a first and second gear in rotating connection with respect to one another so that movement of the first gear will drive the movement of said second gear, said second gear in rotating connection with said retainer.

3. The apparatus of claim 2 wherein said drive means is in connection with a battery powered motor means for driving said retainer in said rotary motion.

4. The apparatus of claim 3 having a gasoline powered motor as means for driving said retainer.

5. The apparatus of claim 1 wherein said abrading means is located beneath one of said rollers and co-planar with the other of said rollers.

* * * * *